US006792997B2

(12) United States Patent
Damiano

(10) Patent No.: US 6,792,997 B2
(45) Date of Patent: Sep. 21, 2004

(54) DEVICE FOR SECURING A STRING LADDER TO THE BOTTOM RAIL OF A HORIZONTAL BLIND ASSEMBLY

(75) Inventor: Anthony B. Damiano, Pembroke Pines, FL (US)

(73) Assignee: RMG Industries, Inc., Miami, FL (US)

( * ) Notice: Subject to any disclaimer, the term of this patent is extended or adjusted under 35 U.S.C. 154(b) by 0 days.

(21) Appl. No.: 10/214,645

(22) Filed: Aug. 7, 2002

(65) Prior Publication Data

US 2004/0026048 A1 Feb. 12, 2004

(51) Int. Cl.[7] ..... E06B 9/30

(52) U.S. Cl. ..... 160/178.1 R; 160/168.1 R; 160/178.3 R; 24/115 F

(58) Field of Search ..... 160/168.1 R, 173 R, 160/177 R, 178.1 R, 178.3 R; 24/115 F, 115 M, 602

(56) References Cited

U.S. PATENT DOCUMENTS

| | | | | | |
|---|---|---|---|---|---|
| 4,487,243 | A | * | 12/1984 | Debs | 160/168 R |
| 4,724,584 | A | * | 2/1988 | Kasai | 24/115 G |
| 4,730,972 | A | * | 3/1988 | Sun et al. | 412/7 |
| 5,147,229 | A | * | 9/1992 | Nestor | 439/843 |
| 5,214,811 | A | * | 6/1993 | Priem | 5/472 |
| 5,542,461 | A | * | 8/1996 | Huang | 160/178.1 |
| 5,542,462 | A | * | 8/1996 | Elsenheimer et al. | 160/178 |
| 5,647,757 | A | * | 7/1997 | Chrysostomou | 439/352 |
| 5,666,699 | A | * | 9/1997 | Takahashi | 24/115 G |
| 5,919,542 | A | * | 7/1999 | Chou | 428/99 |
| 6,119,757 | A | * | 9/2000 | Judkins et al. | 160/178.1 R |
| 6,152,770 | A | * | 11/2000 | Wang | 439/598 |
| 6,263,946 | B1 | * | 7/2001 | Cotten | 160/178.1 R |
| 6,457,242 | B1 | * | 10/2002 | Fogle | 30/347 |
| 6,463,986 | B1 | * | 10/2002 | Gouda | 160/178.1 R |

FOREIGN PATENT DOCUMENTS

| | | | |
|---|---|---|---|
| GB | 2163208 | * | 2/1986 |

* cited by examiner

*Primary Examiner*—Bruce A. Lev
(74) *Attorney, Agent, or Firm*—Robert M. Downey, P.A.

(57) ABSTRACT

A button for securing a string ladder to a bottom rail in a horizontal blind assembly includes a base plate with a central hole and a tubular stem extending upwardly from the base in axial alignment with the central hole for passage of strands of the string ladder therethrough. Arcuate wall segments spaced radially outboard of the central tubular stem have a top beveled edge and longitudinal compression ribs to promote insertion and snug-fitted captured receipt within a countersunk bore in the underside of the bottom rail in order to fasten the button to the bottom rail. Opposing teeth spaced between the arcuate wall segments provide slots for passage and wedged grasping of the ladder strands when the button is fastened to the bottom rail.

5 Claims, 2 Drawing Sheets

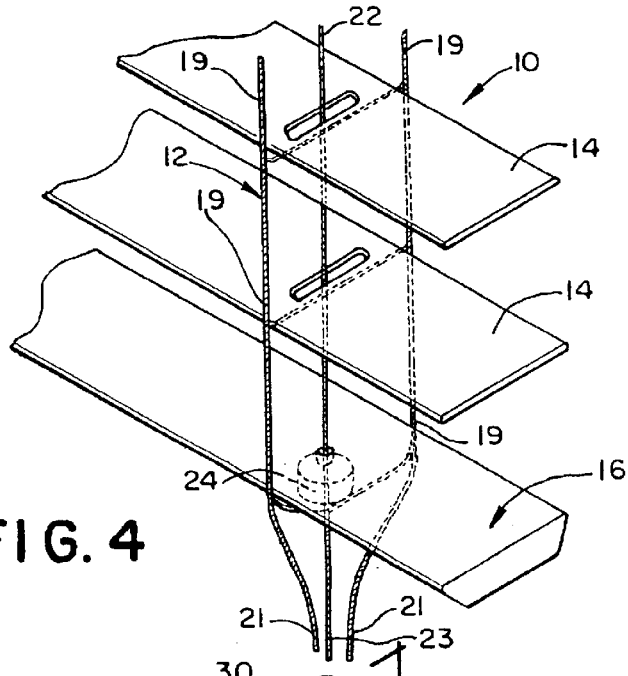
FIG. 4
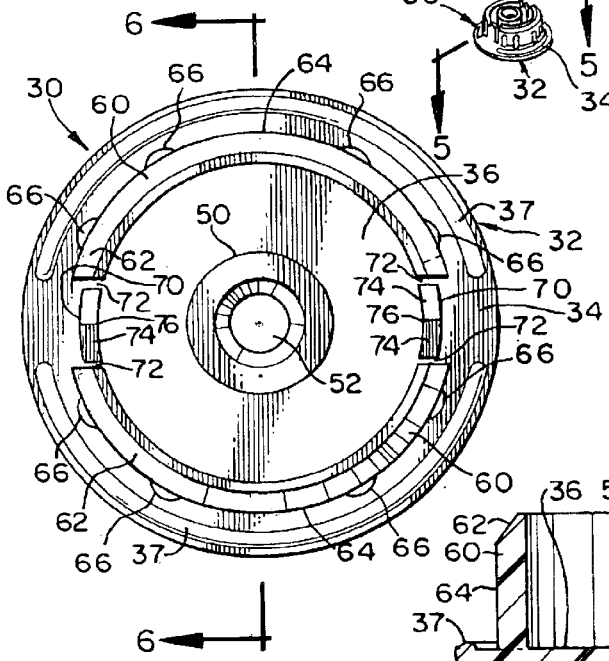
FIG. 5
FIG. 6
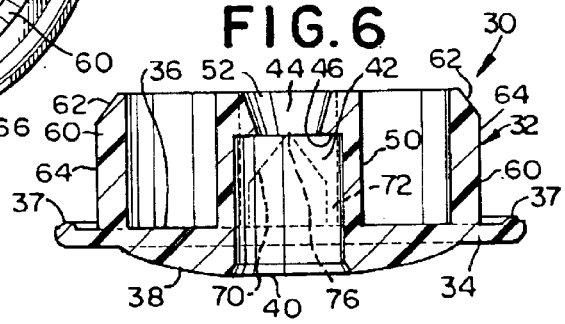

DEVICE FOR SECURING A STRING LADDER TO THE BOTTOM RAIL OF A HORIZONTAL BLIND ASSEMBLY

BACKGROUND OF THE INVENTION

1. Field of the Invention

The present invention relates to a device for use in the assembly of horizontal blinds and, more particularly, to a button for securing the string ladder to the bottom rail of a horizontal blind assembly without the use of a grommet.

2. Discussion of the Related Art

Horizontal blinds are provided with two, and frequently as many as three or four string ladders which extend down from the control mechanism in the headrail to a bottom rail. The string ladders are used to support the horizontal slats of the horizontal blind assembly in spaced relation to one another, while allowing tilting and lifting of the horizontal slats upon manipulating the string ladders using the controls (e.g. cords and/or twist rods) connected to the control mechanism.

In the manufacturing of horizontal blinds, the assembly of the horizontal blind components is performed entirely by hand, requiring approximately one hour of labor. In particular, securing the string ladders to the bottom rail during the manufacturing and assembly of horizontal blinds has been found to be a tedious and time consuming task. All prior art methods have used a metal grommet which is crimped in order to secure the ends of the ladder strands. More specifically, the ladder strands at the bottom of the assembly are passed around the front and rear edges of the bottom rail and are secured on the underside of the bottom rail using the grommet. To do this, the free ends of the ladder are threaded through the grommet and the grommet is pulled up the ladder against the underside of the bottom rail until the bottom rail is held at the desired level. Next, the grommet is crimped to lock the grommet in place by pinching the ladder strands, thereby holding the bottom rail at the desired level on the string ladder. The loose ends of the string ladder, below the grommet, are then cut and discarded. Finally, one of various cover devices is fitted to the bottom rail in order to conceal the grommet and cut ends of the string ladder.

In the past, various devices have been provided for concealing the grommet and cut ends of the string ladder of assembled horizontal blinds. For instance, snap-on band devices, often referred to as "tape locks" are well known and used on many old style bottom rails which have a generally rectangular cross-sectional configuration. More recent designs of bottom rails incorporate a generally trapezoidal cross-sectional configuration which does not allow snap attachment of tape locks. This has lead to the development of other devices which plug into a countersunk bore formed on the underside of the modern design bottom rail. One such plug device well known in the industry incorporates a hollow tubular member with a flared bottom. In use, the ends of the ladder are passed through the tubular member and the grommet is secured at the desired location. The plug is then inserted into a hole in the underside of the bottom rail and the ladder is pulled up to move the grommet into concealed position within the tubular member. This device is often referred to as a "Mexican hat" due to its configuration. Another device, referred to as a "button," snaps into place within the countersunk bore formed in the underside of the bottom rail to conceal the grommet and cut ends of the ladder strands. This button device, also well known in the industry, does not incorporate a through hole. Therefore, it is necessary to bunch up the end of the string ladder and the grommet, for concealed capture within the button, prior to securing the button to the bottom rail. This process has proven to be time consuming and tedious, adding to the labor time necessary to manufacture a horizontal blind assembly. All of the above-described devices and methods of securing a string ladder to the bottom rail of a horizontal blind assembly require the use of a metal grommet, which increases the labor time and cost in the manual assembly process.

Accordingly, there is an urgent need in the horizontal blind industry for a device which easily and quickly fastens to the bottom rail of a horizontal blind assembly to secure the lower end of the string ladder to the bottom rail in the manufacturing and assembly process.

SUMMARY OF THE INVENTION

The present invention is directed to a device for securing a string ladder to the bottom rail in a horizontal blind assembly. More particularly, a button includes a base plate with a central hole and a tubular stem extending upwardly from the base in axial alignment with the central hole for passage of strands of the string ladder therethrough. Arcuate wall segments spaced radially outboard of the central tubular stem are provided with a top beveled edge and longitudinal compression ribs to promote insertion and snug-fitted captured receipt within a countersunk bore in the underside of the bottom rail in order to fasten the button to the bottom rail. Opposing teeth spaced between the arcuate wall segments provide slots for passage and wedged grasping of the ladder strands when the button is fastened to the bottom rail.

BRIEF DESCRIPTION OF THE DRAWINGS

For a fuller understanding of the nature of the present invention, reference should be made to the following detailed description taken in conjunction with the accompanying drawings in which:

FIG. 4 is an isolated top perspective view, of a lower portion of a horizontal blind assembly, including a bottom rail, illustrating the button device of the present invention for securing the cut strands of the string ladder of the horizontal blind assembly to the bottom rail;

FIG. 5 is a top plan view of the button device of the present invention, viewed in the direction indicated by the arrows 5—5 in FIG. 4; and FIG. 6 is a cross-sectional view taken along the plane indicated by the arrows 6—6 in FIG. 5.

Like reference numerals refer to like parts throughout the several views of the drawings.

DETAILED DESCRIPTION OF THE PREFERRED EMBODIMENT

Figure 1:
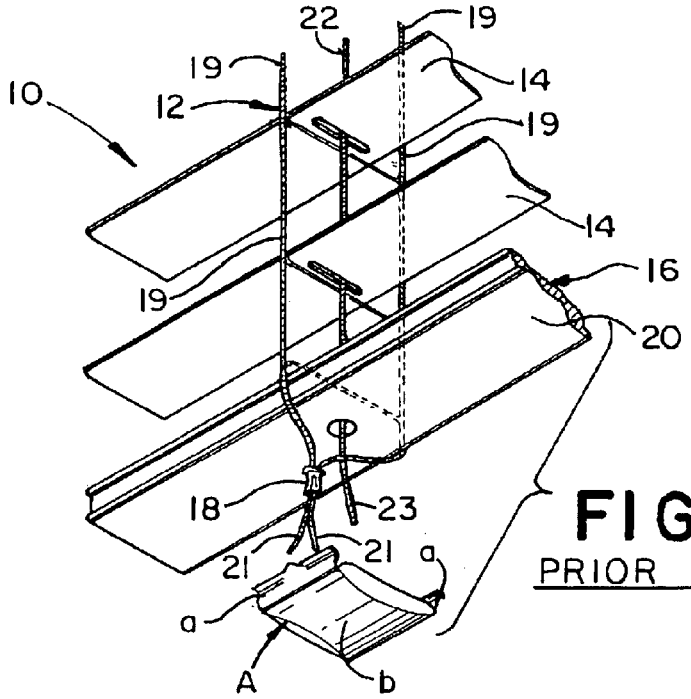
FIG. 1 PRIOR ART
FIG. 1 is an isolated perspective view of the lower portion of a horizontal blind assembly illustrating a prior art device used for concealing a grommet and the cut ends of strands of a string ladder on the underside of a bottom rail of the horizontal blind assembly.
Figure 2:
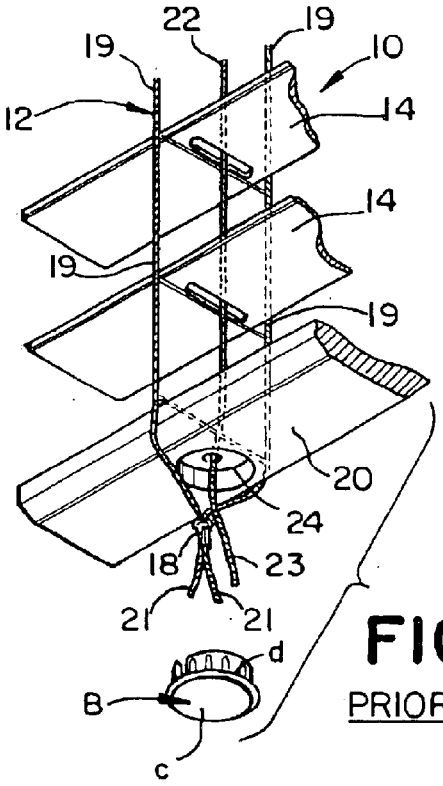
FIG. 2 PRIOR ART
FIG. 2 is an isolated perspective view of a lower portion of a horizontal blind assembly showing another prior art device used for concealing the grommet and cut ends of the string ladder strands on the underside of a bottom rail of the horizontal blind assembly.
Figure 3:
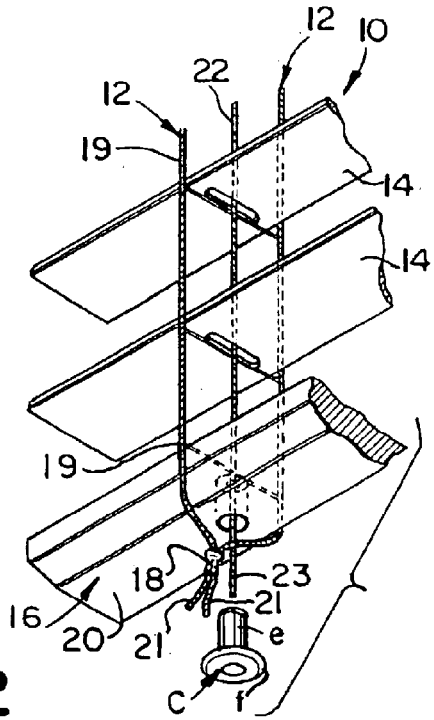
FIG. 3 PRIOR ART
FIG. 3 is an isolated perspective view of a lower portion of a horizontal blind assembly showing yet another prior art device used for concealing the grommet and cut lower ends of the string ladder strands on the underside of the bottom rail of the horizontal blind assembly.

Referring initially to FIGS. 1–3, various examples of prior art devices are shown for attachment to the bottom rail of a horizontal blind assembly in order to conceal the cut ends of string ladder strands and a grommet fastened to the string ladder on the underside of the bottom rail. More specifically, the horizontal blind assembly 10 is normally provided with two or more string ladders 12 extending downwardly from a headrail (not shown) for supporting a plurality of horizontal slats 14 and the bottom rail 16 in spaced, parallel relation to one another. The string ladders 12 also allow tilting and lifting of the horizontal slats upon manipulation of the string ladders using cords and/or twist rods connected to a control mechanism (not shown) contained within the headrail. In the prior art, the grommet 18 is fastened to the lower ends 21 of the strands 19 of the string ladder 12 in order to position and support the bottom rail on the lower end of the ladder. In assembly, once the strand ends of the ladder are fed through the grommet, the grommet is pulled up towards the underside 20 of the bottom rail 16. After the grommet is pulled up the ladder to a position which holds the bottom rail at the desired level, it is crimped so that it pinches the ladder strands together, thereby supporting the bottom rail on the lower end of the ladder.

Referring to FIG. 1, a first prior art device is shown and generally indicated as A for attachment to the bottom rail 16 in order to cover and conceal the grommet and cut ladder strand 21 ends on the underside 20 of the bottom rail 16. The prior art device A, often referred to as a "tape lock," is generally in the form of a 1–3 inch wide band having resilient clasping arms a extending upwardly from opposite sides of a bottom plate b. The clasping arms a are specifically structured and configured to snap on to the opposite front and rear edges of the bottom rail to secure the tape lock device A to the bottom rail so that the plate b extends across the underside 20 of the bottom rail 16 in covering, concealing relation to the grommet 18 and strand ends 21 of the string ladder 12.

Referring to FIG. 2, another device in the prior art is shown for concealing the grommet 18 and cut strand ends of the string ladder on the underside of the bottom rail of the horizontal blind assembly. Specifically, a button B includes a bottom cap c and an annular wall on a top side of the cap. The annular wall d surrounds a cavity for containing the grommet and cut strand ends of the string ladder. In use, the grommet and strand ends are gathered and tediously packed within the cavity as the annular wall is inserted within the countersunk bore formed in the underside of the bottom rail. Ribs are sometimes formed about the annular wall to provide frictional engagement against the surfaces of the countersunk bore which serves to hold the button in place once inserted within the countersunk bore. When properly fastened to the bottom rail, the button B conceals the grommet and cut strand ends of the string ladder within the cavity of the button.

Referring to FIG. 3, a prior art plug device C is shown. The plug C includes a hollow tubular member e with a flared bottom f. In use, the grommet 18 and strand ends 21 of the string ladder 12 are passed through the hollow tubular member e and, subsequently, the hollow tubular member is inserted into a hole in the underside 20 of the bottom rail 16 until the flared bottom rim of the plug device C mates against the underside of the bottom rail, surrounding the hole. The grommet and strand ends are then tucked into the hollow tubular member e so that they are concealed from view.

The prior art devices, as shown and described in connections with FIGS. 1–3, are all intended to conceal the otherwise unsightly appearance of the grommet 18 and cut strand ends 21 of the string ladder 12 on the underside 20 of the bottom rail 16 in horizontal blind assemblies. The use of each of these devices in the manufacturing and assembly of horizontal blinds requires the independent and tedious step of fastening the grommet to the cut strand ends of the string ladder and the subsequent, independent step of fastening the concealing device to the bottom rail in a manner which effectively hides the cut strand ends and grommet from view. As mentioned above, the independent, time-consuming and tedious steps which involve the use of a grommet to secure the string ladder to the bottom rail adds to the overall cost of the manufacturing and assembling process of horizontal blinds.

Referring now to FIGS. 4–6, the device 30 of the present invention is shown. Specifically, the device 30 is directed to a button 32 for securing the lower ends 21 of the strands 19 of the string ladder 12 to the bottom rail 16 of the horizontal blind assembly 10. The button 32 is integrally formed as a one-piece structure, preferably of a plastic composition, through an injection mold manufacturing process. The integral, one-piece button 32 includes a base plate 34 having a top surface 36, a bottom surface 38 and a central hole 40 formed therethrough and communicating with a lower cylindrical passage 42 and upper cylindrical passage 44. A shoulder 46 is formed between the lower and upper passages 42, 44. The cylindrical passages 42, 44 are surrounded by a tubular stem 50 which is integral with the base plate. The tubular stem 50 extends upwardly from the top surface 36 of base plate 34 to a top opening 52 at the upper end of the upper cylindrical passage 44. In use, the strand ends 21 of the string ladder 12 are passed down through the top opening 52, through the upper and lower cylindrical passages 44, 42 and out through the bottom hole 40 prior to securing the button 32 to the bottom rail 16, as described more fully hereinafter.

The button 32 further includes arcuate wall segments 60 integral with the base plate 34 and extending upwardly from the top surface 36 to a top beveled edge 62. An outer surface 64 of the arcuate wall segments 60 defines an outermost diameter of the combined wall segments which is specifically sized for fitted receipt within a countersunk bore 24 formed in the underside 20 of the bottom rail 16. The beveled top edge 62 promotes insertion of the arcuate wall segments within the countersunk bore 24. The outer surface 64 of the arcuate wall segments 60 may further be provided with spaced, longitudinal compression ribs 66 for frictional engagement with the surrounding cylindrical surface of the countersunk bore 24, thereby allowing for snug fitted, captured receipt of the arcuate wall segments 60 within the countersunk bore to secure the button 32 to the bottom rail 16.

Opposing teeth 70 are positioned between the arcuate wall segments 60 to form narrow gaps 72 between the teeth 70 and the ends of the arcuate wall segments. The top ends 74 of the teeth 70 are angled downwardly from a distal point 76 to direct the strand ends 21 into the gaps 72 upon insertion of the button 32 into the countersunk bore 24 on the underside 20 of the bottom rail 16.

In use, the strand ends 21 of the string ladder 12 are gathered together, along with an end 23 of a central lifting strand 22 of the horizontal blind assembly 10. Then, while holding the button 32 in one hand and the gather strand ends 21, 23 in the other hand, the strand ends 21, 23 are directed through the top opening 52 and through the upper and lower cylindrical passages 44, 42 respectively. Once the strand ends 21, 23 exit the bottom central hole 40 they are again grasped with the fingers of one hand, while the button 32 is advanced upwardly, using the other hand, along the strands 19, 22. Then, while holding the bottom rail 16 at the desired level on the string ladder 12, the button is inserted into the countersunk bore 24 on the underside 20 of the bottom rail 16 while pulling the strand ends 21, 23 downwardly to eliminate any slack. As the button 32 is inserted into the countersunk bore 24, the strands 19 of the string ladder 12 should be maintained in alignment with the opposite teeth 70 so that upon continued insertion of the button 32 into the countersunk bore, the strands 19 will be guided into the gaps and wedged tight to secure the stands to the button and bottom rail. The button 32 is pressed into the countersunk bore 24 until an annular rim 37 on the top surface 36 of the base plate 34 engages the underside surface of the bottom rail surrounding the countersunk bore. The central lifting strand 22 is then pulled tight and a knot is formed in the strand end 23 and pulled tight up into the lower cylindrical passage 42 to confront the shoulder 46 formed between the upper and lower cylindrical passages 44, 42, respectively. This allows the central lifting strand 22 to be pulled up, using the control mechanisms of the horizontal blind assembly, without slipping through the button 32 or bottom rail, and thereby lifting the bottom rail 16 and horizontal, parallel slats in successive order until the bottom rail has been raised to the desired height.

While the instant invention has been shown and described in accordance with preferred and practical embodiments thereof, departures from the instant disclosure are contemplated within the spirit and scope of the invention and are not to be limited except as set forth in the following claims as interpreted under the doctrine of equivalents.

What is claimed is:

1. A device for securing strands of a string ladder to a bottom rail of a horizontal blind assembly wherein the bottom rail is provided with a countersunk bore formed in its underside, said device comprising:

an integrally formed, one piece button including:

a base plate having a top side, a bottom side and a central hole formed therethrough;

a tubular stem extending upwardly from said top side of said base plate and terminating at a top opening, said tubular stem surrounding a through passage between said central hole in said base plate and said top opening of said tubular stem, said through passage being structured and disposed for receipt of the strands of the string ladder therethrough;

a plurality of arcuate wall segments extending upwardly from said top side of said base plate and each of said plurality of arcuate wall segments having an outer wall surface structured and disposed for snug fitted receipt within the countersunk bore in the bottom rail; and a plurality of teeth members extending upwardly from said top side of said base plate between said plurality of arcuate wall segments, said plurality of teeth members forming a plurality of gaps between said plurality of teeth members and said plurality of arcuate wall segments, and said plurality of gaps being structured and disposed for wedged, grasping receipt of the strands of the string ladder therein, and each of said plurality of teeth members having a top end with angled surfaces extending from a distil point, said top end of each of said plurality of teeth members being structured and disposed for directing the strands of the string ladder into said gaps upon insertion of said button into the countersunk bore in the bottom rail.

2. The device as recited in claim 1 wherein said plurality of arcuate wall segments each include a plurality of longitudinally extending rib members on an outer surface for frictional engagement within the countersunk bore in the bottom rail.

3. The device as recited in claim 2 wherein said through passage between said central hole and said top opening includes a lower portion of a first diameter and an upper portion having a smaller diameter than said lower portion, and a shoulder formed between said lower and upper portions of said through passage, and said shoulder being structured and disposed for engaging a knot of a string segment to thereby prevent passage of said knot from said lower portion and into said upper portion and out of said top opening of said tubular stem.

4. A device for securing strands of a string ladder to a bottom rail of a horizontal blind assembly wherein the bottom rail is provided with a countersunk bore formed in its underside, said device comprising:

an integrally formed, one piece button including:

a base plate having a top side, a bottom side and a central hole formed therethrough;

a tubular stem extending upwardly from said top side of said base plate and terminating at a top opening, said tubular stem surrounding a through passage between said central hole in said base plate and said top opening of said tubular stem, said through passage being structured and disposed for receipt of the strands of the string ladder therethrough;

a plurality of arcuate wall segments extending upwardly from said top side of said base plate and each of said plurality of arcuate wall segments having an outer wall surface structured and disposed for snug fitted receipt within the countersunk bore in the bottom rail;

a plurality of teeth members extending upwardly from said top side of said base plate between said plurality of arcuate wall segments, said plurality of teeth members forming a plurality of gaps between said plurality of teeth members and said plurality of arcuate wall segments, and said plurality of gaps being structured and disposed for wedged, grasping receipt of the strands of the string ladder therein, and each of said plurality of teeth members having a top end with angled surfaces extending from a distil point, said top end of each of said plurality of teeth members being structured and disposed for directing the strands of the string ladder into said gaps upon insertion of said button into the countersunk bore in the bottom rail; and a plurality of longitudinally extending rib members formed on an outer surface of each of said plurality of arcuate wall segments for frictional engagement within the countersunk bore in the bottom rail.

5. The device as recited in claim 4 wherein said through passage between said central hole and said top opening includes a lower portion of a first diameter and an upper portion having a smaller diameter than said lower portion, and a shoulder formed between said lower and upper portions of said through passage, and said shoulder being structured and disposed for engaging a knot of a string segment to thereby prevent passage of said knot from said lower portion and into said upper portion and out of said top opening of said tubular stem.

* * * * *